United States Patent [19]

Chow et al.

[11] 4,361,194

[45] Nov. 30, 1982

[54] BEARING SYSTEM FOR A DOWNHOLE MOTOR

[75] Inventors: Jacob Chow, Salt Lake City; John S. Davis, Sandy, both of Utah

[73] Assignee: Christensen, Inc., Salt Lake City, Utah

[21] Appl. No.: 192,280

[22] Filed: Sep. 30, 1980

[51] Int. Cl.[3] ..... E21B 4/02

[52] U.S. Cl. ..... 175/107

[58] Field of Search ..... 175/107; 418/48; 415/50

[56] References Cited

U.S. PATENT DOCUMENTS

| | | | |
|---|---|---|---|
| 3,659,662 | 5/1972 | Dicky | 175/107 |
| 3,807,513 | 4/1974 | Kern | 175/107 |
| 3,879,094 | 4/1975 | Tschirky | 308/230 |
| 3,971,450 | 7/1976 | Fox | 175/107 |
| 4,280,524 | 7/1981 | Beimgiaben | 175/107 |

*Primary Examiner*—William F. Pate, III

*Attorney, Agent, or Firm*—Rufus M. Franklin

[57] ABSTRACT

An improved bearing system for the driven shaft of a downhole motor is shown that provides a main thrust and radial bearing system having means for sealing the bearings in oil at equal or slight pressure above that of the drilling mud inside the drill pipe and insulating the fluid seals and bearings from all possibility of contact with cuttings and debris from the drilling operation. A durable seal having a restricted flow path permitting slow leakage is positioned below the main bearing system in such a relationship to the drilling fluid distribution path that the seals for the oil bath for the bearings are subjected to essentially the same pressure on all sides.

28 Claims, 9 Drawing Figures

Fig. 3
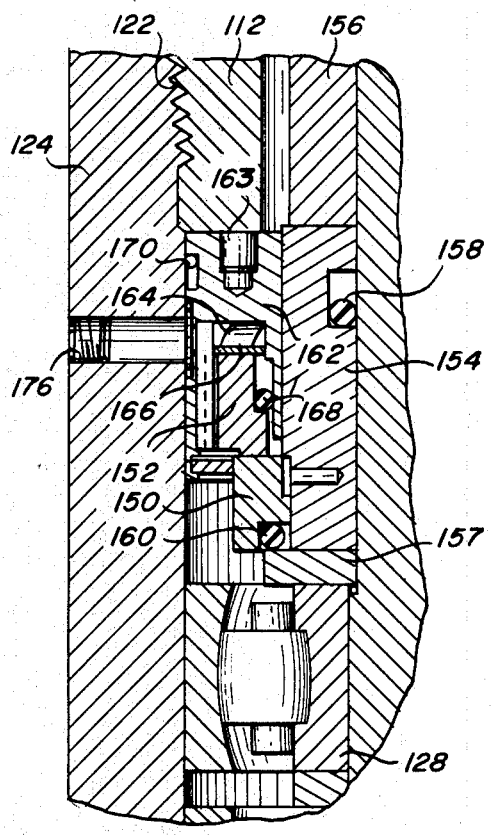
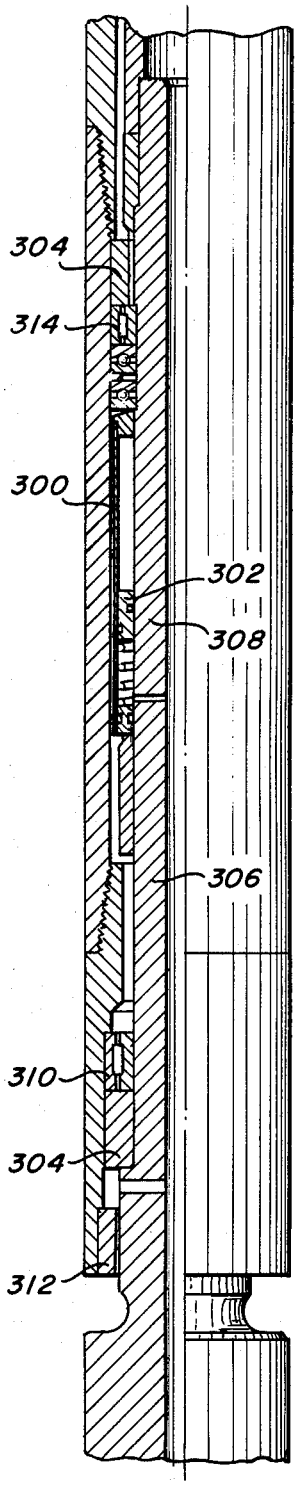
Fig. 5

BEARING SYSTEM FOR A DOWNHOLE MOTOR

PRIOR ART

Designs are known that provide sealed chambers for the main bearing system that are filled with oil for enclosing the bearings for the driven shaft of a downhole motor. The patent to Dicky, U.S. Pat. No. 3,659,662 of May 2, 1972, shows a layout making use of bearing means having seals that are exposed to annulus fluid that is at the same pressure as the fluid surrounding the tool. This annulus fluid contains abrasive drill cuttings.

A patent to Fox, U.S. Pat. No. 3,971,450 of July 27, 1976, shows another sealed bearing chamber for the driven shaft of a downhole motor that requires the use of seal means operative to prevent mud from flowing from the inside to the outside of the tool. There are no known seals capable of performing this function that will run continuously for any length of time under such conditions.

The Tschirky patent, U.S. Pat. No. 3,879,094 of Apr. 2, 1975, shows the use of wear resistant radial bearing means, having passageways for lubrication of the bearing by drilling mud.

BRIEF DESCRIPTION OF THE INVENTION

The main radial and thrust bearings for the driven shaft of the downhole motor of this improvement, are sealed in oil under a pressure greater than the fluid pressure prevailing at the bottom of the well where the tool carried on the lower end of the driven shaft, is working. As is usual, the drilling fluid, customarily a mud slurry, is circulated down the drill string under a considerable pressure to flow through a motor to drive a rotating shaft, on the lower end of which a cutting or other rotary tool is mounted. The drilling fluid, after delivering a portion of its energy to the motor, is delivered through the central bore of the driven shaft, from which most of this fluid issues through suitable ports at the lower end of the driven shaft to wash the cuttings away from the tool and up the bore hole.

The driven shaft is rotatably mounted on radial and thrust bearings that are sealed in an oil filled chamber under a pressure equal to or slightly greater than the fluid pressure within the central bore of the tool. In addition a restricted passage seal bleeds a small flow of drilling fluid off from the central passageway at the lower end of the driven shaft.

The present construction uses the drilling fluid flowing downwardly through the bore in the driven shaft, to pressurize the oil in the sealed main bearing chamber for the driven shaft. A sliding piston on one side of this sealed bearing chamber is shown urged by a spring to produce an additional pressure on the oil sealed around the main radial and thrust bearings so that any leakage that might occur would cause oil to escape from the chamber rather than permit external fluid to flow into the main bearing chamber. The spring is optional and may be eliminated without departing from the invention.

The drilling fluid exits in two different paths from the bore at the lower end of the driven shaft, the fluid being at a higher pressure than the fluid in the well annulus. The largest volume of flow from the bore issues from the lower end of the bore through jets in the tool structure so that it flushes away the cuttings and cools and lubricants the tool. A smaller portion of the fluid is diverted into a chamber below the piston seal and then exists into the well through a lower seal having a restricted flow path.

While prior art structures (such as in FIGS. 8 and 9 in the Fox patent) provide a resilient seal designed to prevent leakage, at this point, the present invention provides a durable seal which is made of hard metal, cemented tungsten carbide, or the like, and which derives its durability from the fact that a small amount of leakage is tolerated, while retaining full internal mud pressure against the annular piston which pressurizes the bearing lubricant.

DRAWINGS

FIG. 3 is a detailed sectional view of a seal at one end of the construction shown in FIG. 2;

FIG. 5 is a longitudinal sectional view similar to FIG. 2 showing an assembly illustrating another form of bearing means;

DETAILED DESCRIPTION

Figure 1:
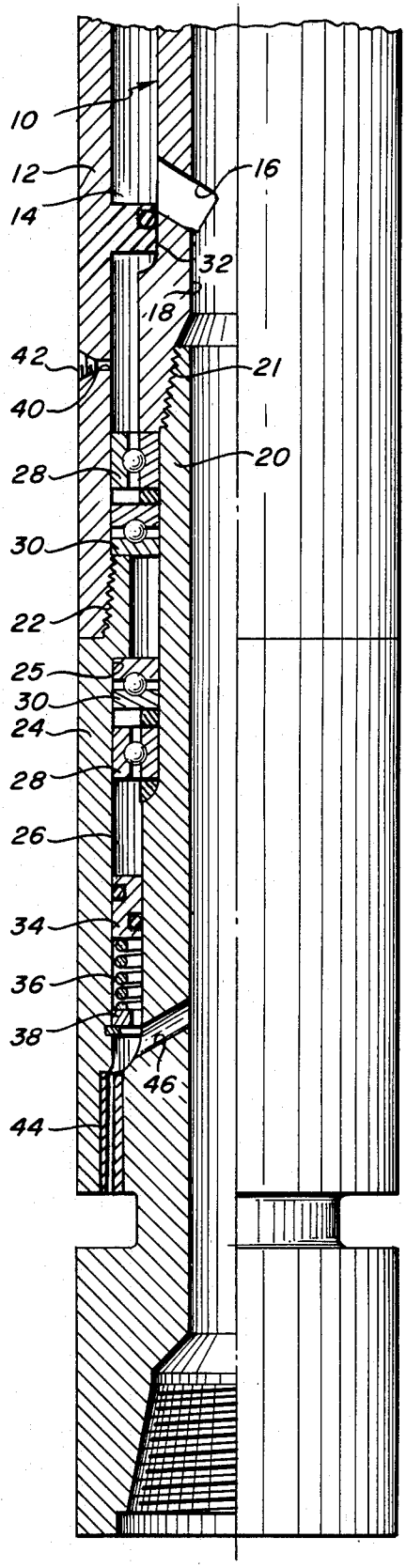
FIG. 1 is a longitudinal sectional view of the basic form of this invention.

The basic structure of the bearing assembly of the invention is shown in FIG. 1, wherein the shaft generally designated 10 is rotatably driven by a downhole turbine or the like (not shown). This driven shaft extends downwardly inside the housing 12. Drilling fluid is delivered down the drill pipe at high pressure to the motor and flows under a somewhat reduced pressure from the motor to pass between the housing 12 and shaft 10 in space 14, from where it flows through apertures 16 in shaft 10 to continue its passage downwardly through the center bore 18 in shaft 10. An extension 20 is threaded to the driven shaft 10 at joint 21 to support a drill bit (not shown) at its lower end. The extension 20 has a central bore therethrough that forms a continuation of bore 18. The drilling fluid flows down bore 18 to issue through fluid jets in the drill bit, as is conventional, to aid in the earth boring operation, to assist in the cutting action and then wash away the debris resulting from the drilling action.

At the lower end of casing 12, there is a threaded connection 22 to support a downwardly extending housing 24 having an inner wall 25 that is spaced from the periphery of extension 20 to provide a bearing chamber 26 for containing spaced apart pairs of radial bearings 28 and thrust bearings 30. The upper end of chamber 26 extends above the threaded connection 22 to a seal 32 fixedly positioned in casing 12 just below the entrance to aperture 16 through which the drilling fluid flows from space 14 into bore 18. The seal 32 is exposed on its upper side to the drilling fluid from flowing from space 14 into chamber 26.

The lower end of chamber 26 is sealed by an annular piston-like seal 34 having a sliding engagement within housing 24 and on the outside of the extension 20. The slidable seal may optionally be urged upwardly into chamber 26 by spring 36 that is seated on shelf 38 at one end and bears against the underside of piston seal 34 at its other end. As shown here, the seals 32 and 34 include O-rings carried in annular seats on the respective peripheral surfaces.

The chamber 26 is adapted to be filled with a bearing lubricating oil through entrance 40 that is sealed with a threaded cap 42. The piston seal 34 is pushed downwardly against the tension of spring 36 as the chamber is filled with oil under pressure.

At the lower end of housing 24, there is a seal 44 which, as will appear more fully below, provides a restricted flow passage that throttles a portion of the drilling fluid that flows from bore 18 through passage 46 into the bottom end of chamber 26 below piston seal 34. The clearance between the elements of seal 44 may typically be 0.008 to 0.010 inches. The drilling fluid that passes through this bearing flows into the annulus around housing 12 and housing 24 at a point above the tool bit.

The drilling fluid flowing from passage 46 into chamber 26 acts against the underside of the piston seal 34 to pressurize the oil trapped in the bearing chamber. Since the flow passage 46 has essentially zero resistance to flow as compared to the restriction at 44, it is apparent that the pressure on the body of oil sealed around the bearings in chamber 26 is at least equal to the fluid pressure on the outside of seal 32 and piston seal 34. Thus, since the fluid pressure in passage 14 above seal 32 and the fluid pressure under piston seal 34 are balanced and the spring 36 may be employed to maintain an additional pressure on the oil in chamber 26, it is apparent that no drill fluid can leak past these seals and any leakage past the seals causes oil to flow from chamber 26 into the drilling fluid. Also, since there is no open passageway between chamber 26 and the annulus outside of the housing 25, there can be no exposure of the O-ring seals to fluid containing cuttings and debris flushed up from the tools.

When the drilling fluid flows down the inside of the casing under working pressure, it is directed into the hydraulic motor for rotating shaft 10. The working fluid then flows at a somewhat reduced pressure into casing 12 to feed through apertures 16 to flow into bore 18. The drilling fluid is, however, still under high pressure to produce a downwardly flow through bore 18 and force a portion of the fluid to flow out passage 46 into chamber 26 below the piston seal 34 and then through the restrictor bearing 44, while the larger portion of the drilling fluid flows downwardly and out into the well through the tool. The remainder of the drilling fluid that is exhausted into the bottom of the well through the tool flows upwardly around the outside of housing 24 and casing 12 to flush the cuttings and other debris upwardly and out of the well.

The large effective seal area, permitted by placing the flow restrictor seal below the bearing section, over which the pressure drop of the drilling fluid acts, produces a force in an opposing direction to the bit weight and thus greatly reduces the load on the thrust bearings.

The flow restrictor type seal, in the event of failure of the radial seal bearings, can take over the function of such bearings until repair is made.

It should also be noted that if all the oil should leak from chamber 26, that only the drill fluid flowing from space 14 in casing 12 and from passage 46 leaking from bore 18 could enter the chamber 26 to come in contact with bearings 28 and 30. The seal 32, at the upper end of chamber 26 and seal 34 at its lower end, are exposed only to clean drill fluids at all times while the cutting tool is being driven so that there is never a time when debris and cuttings from the tool could ever enter the bearing chamber 26 because the drilling fluid must always be at a higher pressure than the pressure of the fluid in the annulus while the downhole motor is running. While this, of course, would not be an ideal condition, it is known that radial and thrust bearings can be designed that do run fairly well when drilling fluid only is used as a lubricant and therefore if the seals should fail, the tool could be operated for a while with only the drill fluid as a lubricant.

Figure 2:
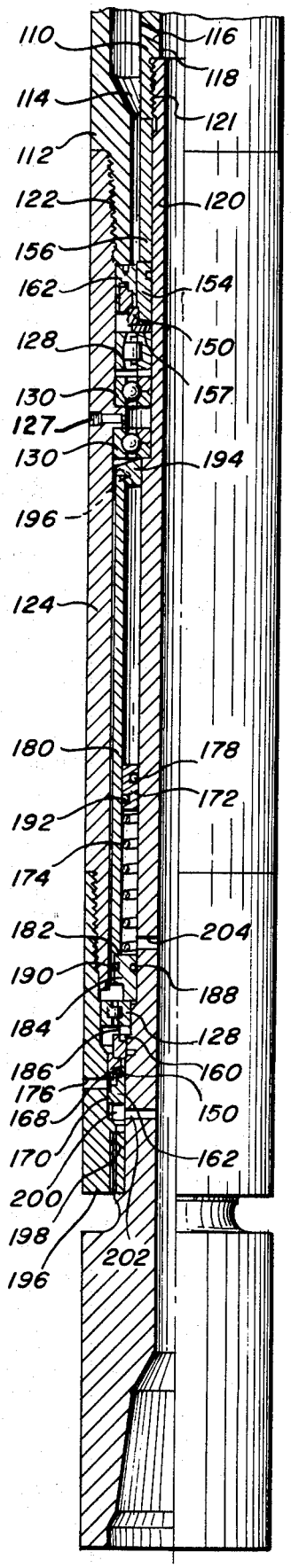
FIG. 2 is a longitudinal sectional view showing a preferred form of the invention.

Referring to FIG. 2, a form of the invention is shown wherein the shaft 10 is rotatably driven by a fluid powered downhole motor (not shown). The driven shaft is mounted on main bearing means to rotate generally concentrically within the relatively stationary casing 112. Drilling fluid that is forced under pressure into the drill string to drive the motor is directed to flow from the motor downwardly in space 114 between housing 112 and shaft 110 and flows from this space through passage 116 into the center bored passage 118 of the driven shaft 110. A hollow extension 120 is threadedly connected to the lower end of the driven shaft 110 by threads 121, the lowermost end of the extension 120 being threaded to receive a drill bit (not shown) adapted to be driven by shaft 110 and the extension 120.

The casing 112 has threaded lower end 122 onto which a downwardly extending housing 124 is screwed. The housing has an inner wall 125 that encloses a chamber 126 formed by the wall 125 and the outer wall of the tool carrying extension 120. Suitable main bearing means including radial and thrust bearing means 128 and 130 are supported between the housing 124 and the driven shaft at the top of chamber 126 and a radial bearing 128 is positioned in chamber 126 at its lowermost end.

The bearings in chamber 126 are bathed in oil which fills the chamber and is continuously pressurized, as will be described below, so that should a leak develop, oil would tend to flow from the chamber rather than there being a leakage of drilling fluid into chamber 126. A rotary face seal means is utilized with this form of the invention that makes use of rubbing surfaces of wear resistant materials such as cemented tungsten-carbide and/or silicon carbide to form a rotary seal in combination with O-ring seals which are in static relation to the elements in contact therewith. Similar seals are used at the upper and lower ends of chamber 126 which are operated at the same hydrostatic pressure imposed on their outside surfaces, with a slightly higher oil pressure (when spring 174 is used) being imposed against their inner surfaces that are exposed to the oil under slightly higher pressure in chamber 126.

The structure of one of the preferred rotary face seals for this purpose at the upper end of chamber 126 is shown in FIG. 3. The elements of this seal that cooperate between the relatively stationary casing 124 and the rotatably driven shaft extension 120 include wear resistant cemented tungsten carbide and/or silicon carbide ring shaped bearing elements 150 and 152. One of these rings 150 is mounted on the lower end of a sleeve 154 that surrounds extension 120 of the driven shaft. The sleeve is held in a fixed position along the outer surface of the extension by a thrust sleeve 156 that bears against the lower end of the driven shaft 110. The sleeve 154 is supported on its underside on spacer ring 157 that is carried on radial bearing 128. The sleeve is sealed against the outside surface of extension 120 by O-ring 158 and the rotating sealing ring 150 is supported on spacer 157 by O-ring 160. The upper surface of ring 150 provides a smooth planar bearing surface against which the lower planar face of ring 152 is resiliently pressed. The ring 152 is supported in a housing member 162 mounted on pins 163 integral with the lower end of casing 112, and held in place by pin 176. The housing loosely surrounds sleeve 154 so that the sleeve may freely rotate therein with shaft 120 while the housing 162 remains relatively fixed. In a recess 164 on its underside, the housing carries ring 152 and this ring is pressed into contact with ring 150 by the wavy form of a circular spring 166 that is trapped between the top of ring 152 and recess 164. O-ring seals 168 and 170 seal the ring 152 and housing 162 respectively against the flow of oil from chamber 126 past the housing. Likewise, O-ring seals 160 and 158 preclude the flow of oil past ring 150 and sleeve 154. It will be noted that all of the O-ring seals 158, 160, 168 and 170 serve their sealing functions while in a substantially compressed static condition and that the seal between the relatively moving parts is effected with the rubbing surfaces of the silicon carbide and cemented tungsten carbide rings 150 and 152. Thus an effective sealing of the oil under a modest pressure in chamber 126 is accomplished without subjecting the elastomeric seals to dynamic conditions which cause premature aging of such seals such as occurs when they are subjected to friction and heat that is generated by rubbing friction encountered in other designs. Further, the seal formed by the rubbing surfaces of the rings 150 and 152 are lubricated with oil from chamber 126 to provide long wear effectively sealing the body of oil in the chamber.

The opposite end of chamber 126 is similarly sealed with a pair of bearings rings 150 and 152 carried by the driven shaft and housing elements respectively to inhibit the leakage of oil from the lower end of chamber 126.

In order to maintain a suitable pressure on the oil in chamber 126 shown in FIG. 2, a sliding piston means 172 is urged by spring 174 to press against the oil filled into chamber 126 through suitable port 127, that is sealed after the chamber has been filled. The compensating piston 172 surrounds the extension 120 of the driven shaft 110 and O-ring seal 178 seals the piston against this surface. The piston means is contained within the compensating sleeve that is open at its top end and concentrically positioned within and spaced from the inner wall of housing 124. At its lower end, the inner wall of the sleeve is provided with a shoulder 182 that bears on a piston spring retainer 184. The retainer 184 is supported on the inner bearing ring of the radial bearing 128 that in turn is supported on a spacer 186 carried on a shoulder on the outer surface of extension 120. The spring retainer 184 is sealed with O-ring 188 against extension 120 and with O-ring 190 against the inside of the compensating sleeve. The compensating piston is also sealed against the inside of sleeve 180 with O-ring 192 and the sliding piston is urged upwardly between the extension 20 and sleeve 180 by spring 174 to produce the desired pressure on the oil in the chamber 126 to preclude the leakage of drilling fluid into the chamber. It will be noted that chamber 126 includes the space above the lowermost rotating seal 150 and stationary seal 152 and around the radial bearing 128 as well as the cylindrical space between the inside wall of housing 124 and the outer surface of sleeve 180. At its upper end chamber 126 includes the space inside sleeve 180 and above the compensating piston 172, the space surrounding thrust bearing 130 and radial bearings 128 and up to the rubbing seal of rings 150 and 152. The compensating piston is urged upwardly by spring 174 (optional) and oil in the space above the piston may flow past the piston retainer 194 through a passageway 196 provided therein to fill the entire space of chamber 126 just described.

At the lower end of the device, a lower bearing housing 196 is threaded onto the end of housing 124 to simplify the assembly of the machine and the inner surface 198 of housing 196 forms a restricted flow passage with the outer surface of extension 120, that also serves as a bearing or journal for the lower end of the extension 120 of the driven shaft 110. Immediately above surface 198, a space 200 is provided between housing 196 and the outer surface of the extension and passageway 202 connects this space with the central bore of the extension through which the drilling fluid is flowing downwardly to the tool. A similar passageway 204 connects the space surrounding the spring 174 with the central bore through the extension 120 so that drilling fluid may enter the space under the compensating piston 172.

This structure functions substantially like the basic structure described above. The drilling fluid under considerable pressure is forced down the drill string to drive the downhole motor to rotate shaft 110 and extension 120. After the fluid leaves the motor, it flows down through housing 112 filling space 114. This fluid exerts pressure on the top of the housing 162 for the rotary face seal means at the top of the chamber 126 and the fluid also flows through passage 116 to flow down the center bore of the driven shaft and its extension to be ejected through the cutting tool at the bottom of the well and through the restriction provided by seal 198 which may be identical to seal 44 of the FIG. 1 species. The drill fluid flows into passage ways 202 and 204 to produce pressure behind piston 172 and on the bottomside of the rotary seal at the bottom of chamber 126.

The use of the rotary face seals 150 and 152 above and below chamber 126 together with the arrangement of sleeve 180 that serves as a cylinder for the compensating piston 172 that rotates with extension 120, provides a sealing arrangement utilizing O-rings in a static condition in an environment that would otherwise produce a premature aging thereof by eliminating the necessity for using O-ring seals to contain the drilling fluid and oil bath in circumstances where the O-rings would be subjected to dynamic stresses. The life of the O-rings are greatly preserved in this design whereby the working life of the cutting tool driving means is greatly prolonged.

Figure 4:
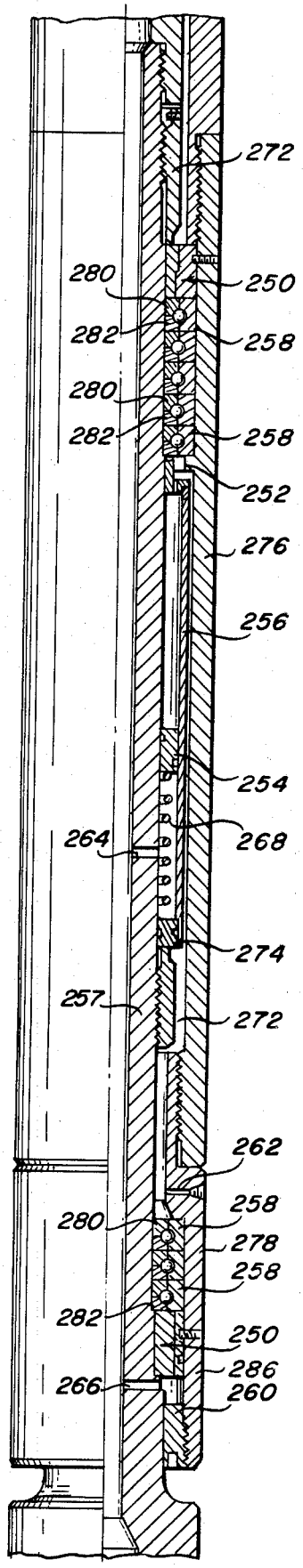
FIG. 4 is a longitudinal sectional view showing an alternate bearing arrangement used in the structure shown in FIG. 2.

A variation of the compensating piston and bearing assemblies for sustaining the radial and thrust loads in association with the rotary face seals is shown in FIG. 4 where a pair of rotary seal bearing means 250, like that shown in FIG. 3, are mounted one above and one below the pressurized oil chamber 252. The compensating piston 254 is supported in sleeve 256 in substantially the same relationship to the driven shaft extension 258 as the structure shown in FIG. 2 and described below.

In FIG. 4, several sets of angular contact bearings 258 are located in chamber 252 next to the upper and lower rotary seals 250. These bearings, so situated, absorb the main radial and thrust loads in the tool and provide the stability which enables the rotary seals to operate at

BEST AVAILABLE COPY their maximum efficiency. As with the structure shown in FIG. 2, this form of the invention also makes use of a seal 260 permitting restricted flow therethrough at the lowermost end of the driven shaft extension to further stabilize the drive to the tool. As in the other species of the invention a typical clearance between the rotary and stationary parts may be 0.008 to 0.010 inches.

The bearing chamber 252 may be loaded with oil under pressure through an inlet 262. Drilling fluid pressure prevails above and below rotary seals 250 as with the structure shown in FIG. 2 and passages 264 and 266 admit drill fluid into the chamber enclosing optional spring 268 and under the lowermost bearing 258 respectively. The drill fluid pressure is established above the upper rotary seal 250 through passage 270 that connects the drill fluid flowing from the motor (not shown) to the central bore passage in shaft 257.

The upper rotary face bearing 250 is assembled with the upper radial and thrust bearings 258 together with sleeve 256 and its compensating piston and spring, on the extension 257 of the driven shaft. Spacers 272 above the upper rotary face seal 250 and below the bottom seal 274 for the chamber enclosing the compensating spring 268, are adjustably threaded onto the outside of the extension 257 to support these elements in longitudinal alignment. The outer housing extension 276 may then be threaded onto the lower end of the well casing. When this partial assembly has been completed, the lower radial and thrust bearings 258 and rotary seal 250 may be fitted onto the lower end of the driven shaft extension 257 and held by the threaded housing 278 threaded to the bottom end of the housing extension 276. Suitable spacer means are provided to hold these bearings seated and the threaded ring 262 that surrounds the lower end of shaft extension 257 completes the assembly when it is threaded into the lower end of the housing extension 278. The inner surface of ring 260 is slightly spaced from the periphery of extension 257 to form a restricted flow passage.

In the construction, the schematically shown rotary face upper and lower 250 that are shown in the detail in FIG. 3, have oil exposed to their inner faces while their outer surfaces are exposed to drilling fluid pressure by drill fluid flowing from the motor and through the centrally bored passage of shaft extension 257. The oil is at a slightly higher pressure than the drilling fluid if spring 268 is employed. The structure of bearings 258 serves to contain the radial and thrust loads substantially within an area closely adjacent the rotary face seals 250 in order to relieve these rotary seals of undue stress. The outer races for bearings 258 are aligned under and are solidly supported against the lower end of the outer casing by means of the extensions 276 and 278 together with properly positioned spacer means positioned between these elements to take the thrust loads and the split internal rings 280 and 282 distribute the radial loads against their support on extension 257.

The structure shown in FIG. 5 is generally similar to that shown in FIGS. 2 and 4 and uses the same general radial and thrust bearing disposition shown in FIG. 4. In this modification the mounting of the bottom end of the sleeve 300 for enclosing the compensating piston 302 is spaced upwardly somewhat from the lower rotary face seal 304 like that shown in FIG. 3 to permit the use of a thicker bottom end 306 on the driven shaft extension 308 for cooperating with a heavier roller radial bearing 310 positioned closely above the rotary face seal. A restricted flow seal 312 is provided. A roller radial bearing 314 may be positioned next adjacent but below the upper rotary face seal 304 and the bearings 310 and 314 to serve to insure rotary surface seal concentricity and therefore a better sealing operation.

Figure 6:
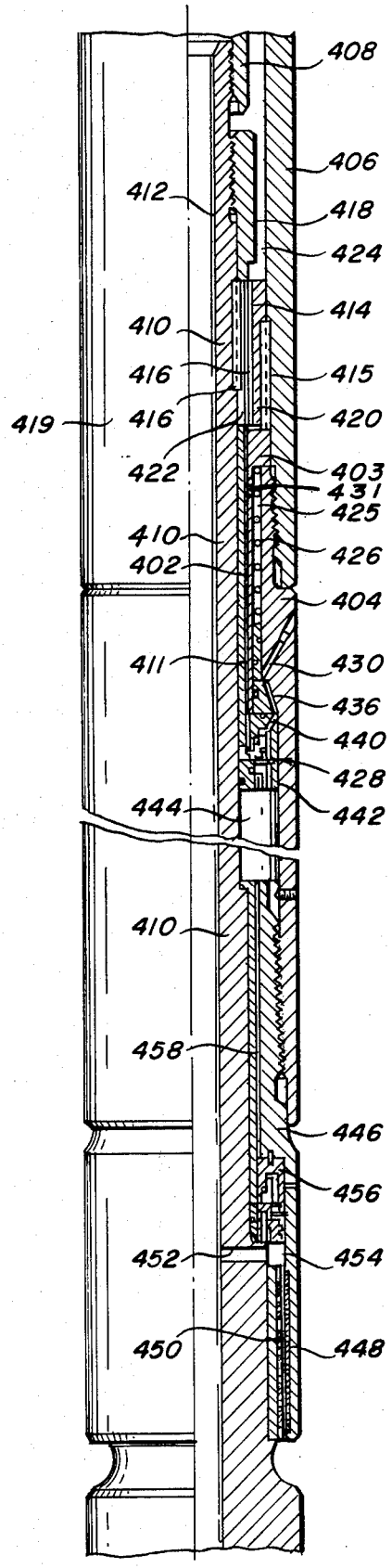
FIG. 6 is a sectional view similar to FIG. 2 but showing another modification of the invention.
Figure 6A:
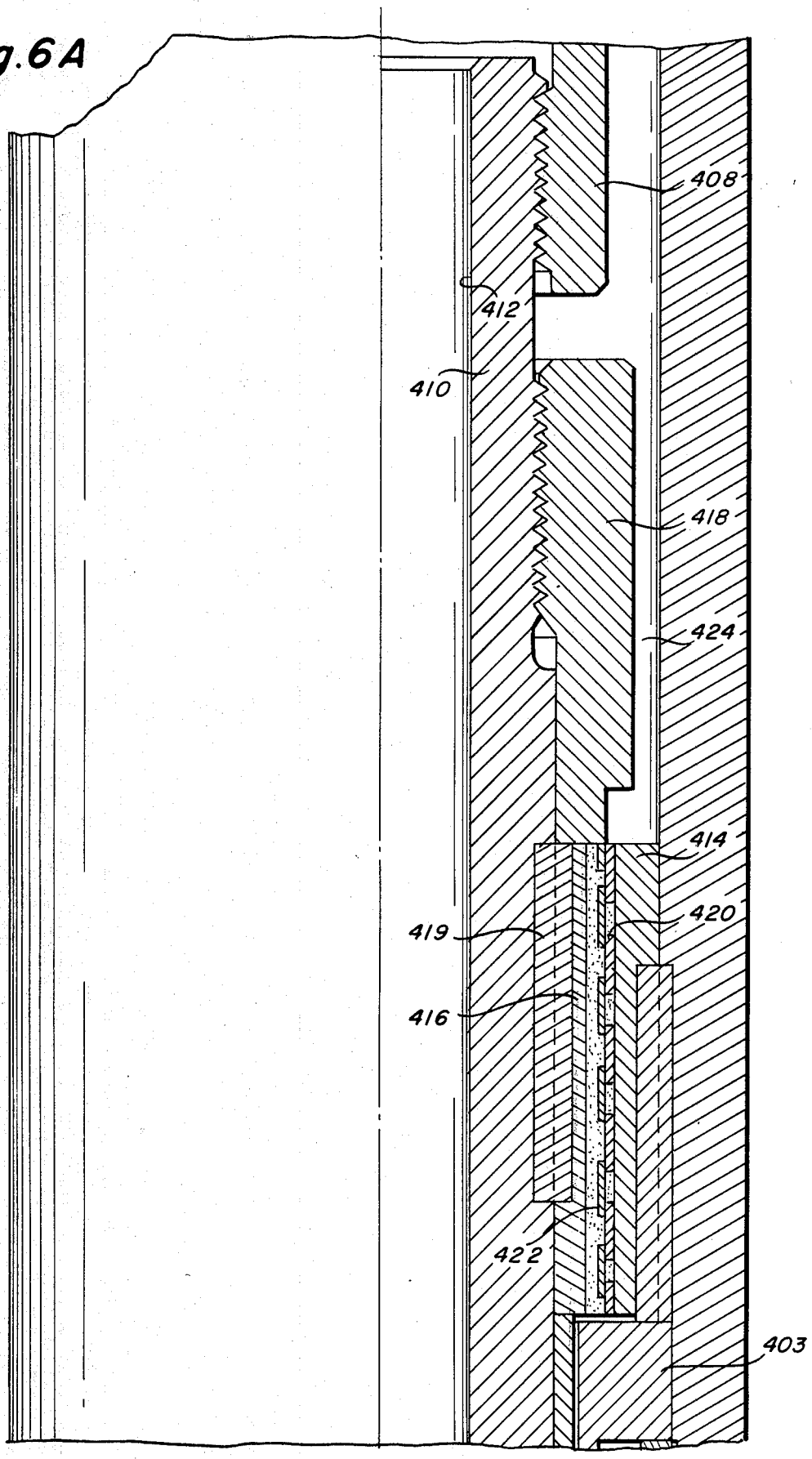
FIGS. 6A, 6B and 6C are enlarged views of the top, middle and bottom sections of the assembly shown in FIG. 6.
Figure 6B:
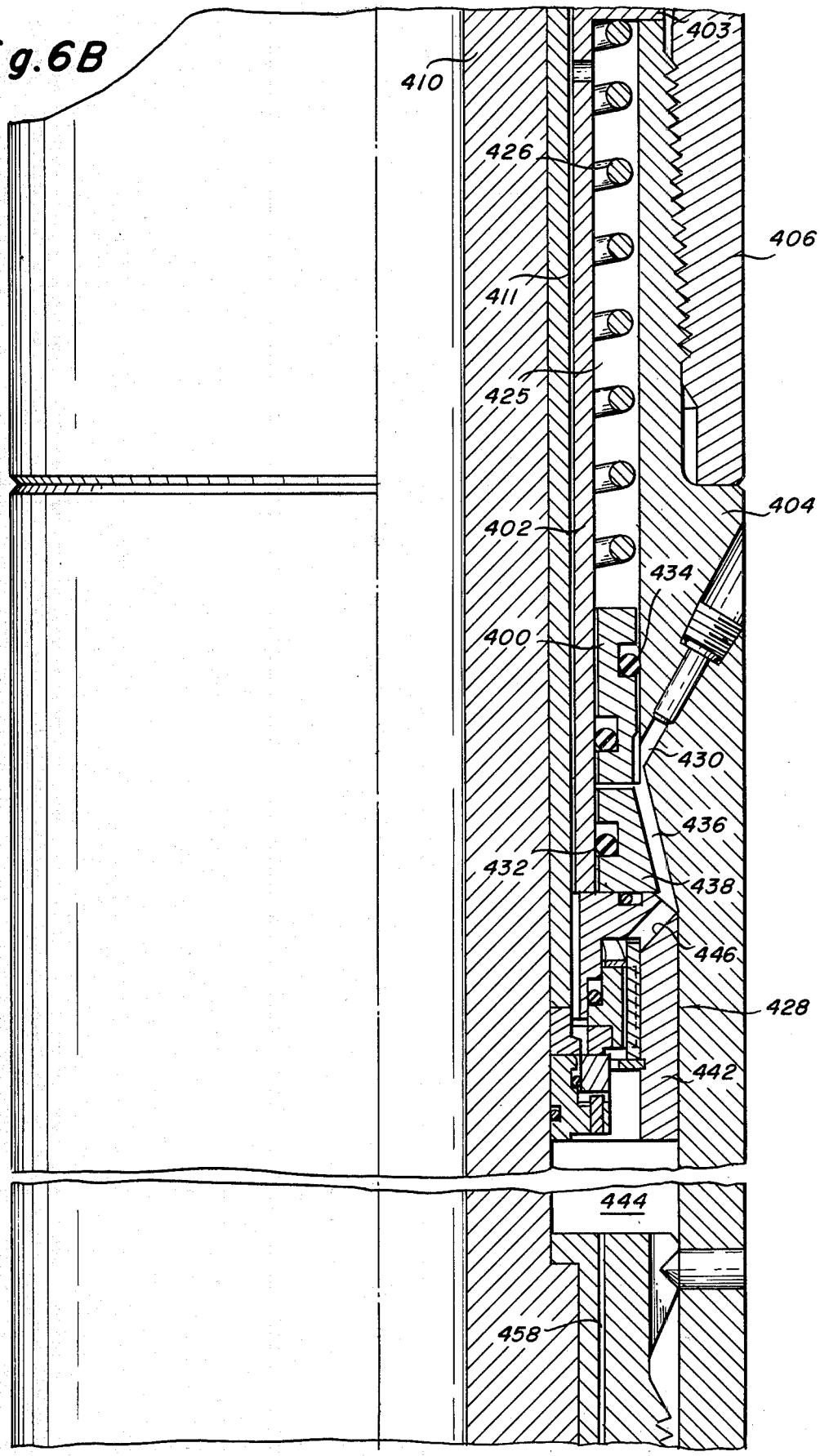
Figure 6C:
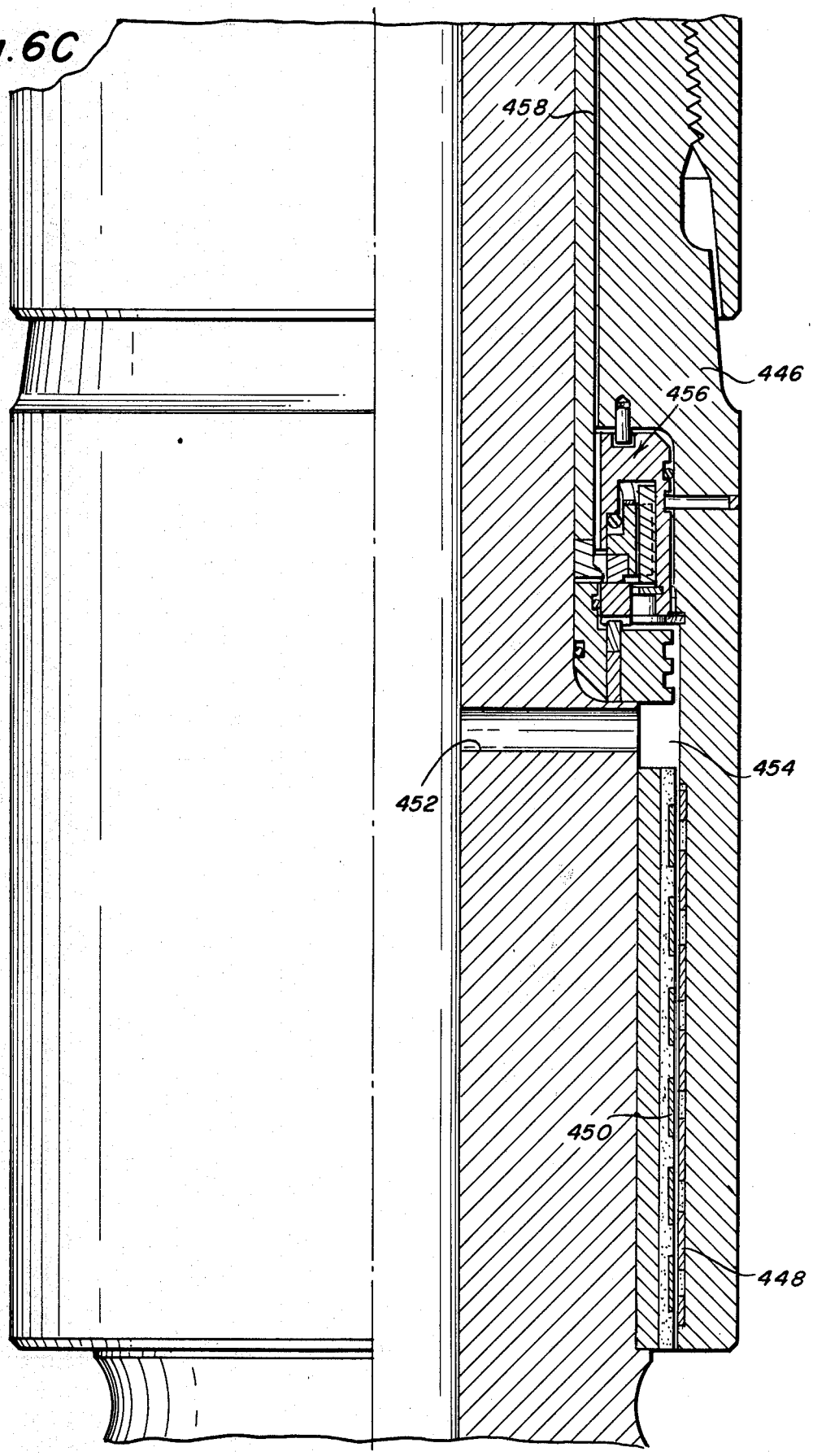

The system shown in FIG. 6 is fundamentally the same as the structure shown in FIG. 2. With this modification the compensating piston 400 and its cooperating sleeve 402 are mounted outside of the pressurized oil chamber and at the upper end of the bearing housing 404 that is threadedly attached to the bottom section of the drill string 406. For this modification, the sleeve 402 has an integral support ring 403 that is engaged between the upper end of housing 404 and lower end of section 405, to be fixed in a relatively stationary position with respect to the rotating driven shaft 408 and its extension 410. The center bore 412 of the extension provides a flow passage for the drill fluid to flow from the motor to the tool. The upper end of the extension 410 is rotatably carried in a radial journal bearing means positioned above sleeve 402.

The journal bearing has cooperating cylindrical bearing sleeves 414 and 416 having bearing faces which have sufficient clearance to provide a restricted flow passage for drilling fluid flowing downwardly in the outer housing 406 and around the outside of a retainer nut 418 that serves along with key means 419 to hold bearing element 416 integral with the driven shaft extension 410. The other bearing ring element 414 is keyed to the outer housing 406 with a spline insert 415. The bearing elements 414 and 416 may include bearing pads 420 and 422 respectively, made of hard bearing material as is known in the art, the relatively moving faces being lubricated by the drilling fluid that may work downwardly from space 424 into the space between these bearings.

The drilling fluid oozes from between the opposed bearing faces and flows downwardly over the support ring 403 and into the space 411 between the outside of a thrust sleeve pressed over the outside periphery of the driven rod extension 410 and the inside periphery of sleeve 402. The sleeve, together with housing 404, forms a chamber 425 that encloses spring 426 which urges compensating piston 400 downwardly to produce the desired differential in oil pressure in the main oil filled bearing chamber positioned below the rotary face seal means 428. The sleeve 402 has a flow passage means 431 through its wall adjacent ring 403 to permit the drilling fluid to flow from space 411 into the chamber containing spring 426 to assist the spring in driving the compensating piston downwardly so that the pressure in the oil filled main bearing chamber is always higher than the fluid pressure surrounding that chamber which pressure is produced to preclude leakage into the oil filled chamber.

The piston as shown in FIG. 6 is at its lowermost position. Normally when the tool is to be used, oil is forced under pressure through inlet 430 into the main bearing chamber under the rotary face seal 428. The inlet may be provided with a check valve so that after the bearing chamber has been filled and the piston 400 driven upwardly to compress spring 426, the check valve holds the oil under pressure until the inlet can be sealed. The inlet communicates with the spring chamber 425 at its lower end to force the piston upwardly, the piston being sealed against the walls of chamber 425 with O-rings 432 and 434. A flow passage 436 is provided through shoulder 438 integral with the upper bearing housing 404 to permit oil to flow from chamber 425 into passage 440 and through the housing element 442 of the rotary face bearing means 428. The passage 440 delivers the oil into the space containing the upper rotary face bearing means and its wavy spring and the oil flows downwardly past the lower rotary face bearing means carried on the extension 410 of the driven shaft to lubricate this rotary seal means, and then the oil fills the main bearing chamber 444. The details of the rotary seal 428 are shown in FIG. 3 described above. It will be observed that normally the drilling fluid will flow around the inside periphery of the housing element 442 and the oil in chamber 444 will be contained on the outer side of the rotary seal means under a slightly higher pressure.

Any of the bearing systems shown in FIGS. 2, 4 and 5 may be installed in bearing chamber 444 to contain substantially all of the radial and thrust loads imposed upon the tool driving means. A seal member allowing limited leakage is preferably installed below the main bearing chamber to the lower end of the driven shaft. This seal is mounted at the lower end of a lower bearing housing 446 fixed to extend downwardly from the lower end of the upper bearing housing 404. The lower seal has bearing pads 448 fixed to its inner periphery, these pads cooperating with pads 450 fixed to the outer periphery of lower end of the extension 410. These inner and outer means 448 and 450 have sufficient clearance to form a restricted flow passage for drilling fluid that flows from the central passage of extension 410 through passage 452 into space 454 and then downwardly between the faces.

Another rotary seal means 456 is positioned between space 454 and the main bearing chamber 444. The rotary seal is mounted at the lower end of the lower bearing housing 446 and is lubricated with oil under pressure from the main bearing chamber by oil flowing through several passages 458 drilled through the bearing housing. Thus it is seen that drilling fluid pressure prevails on the underside of the rotary seal bearing 456 and the normally higher oil pressure in the main bearing chamber is established on the other side of this seal.

The structure shown in FIG. 6 is designed to operate like the tool driving means shown in FIG. 2. The tool mounted at the lower end of the driven rod extension is rotatably driven into the earth and is supported by the main bearings working in the oil filled chamber and the radial journal bearing means. If it should happen, however, that the rotary seal means associated with the oil filled bearing chamber, should fail, the drilling fluid passing through the upper journal means 414–416 could flow past the rotary seal 428 into the main bearing chamber. Bearing means can be selected that will have a degree of tolerance to the use of drilling fluid as a lubricant and therefore it is seen that even if the oil pressure in the bearing chamber should drop, a limited degree of lubrication is provided with this construction which will enable the tool to be driven for hours longer until the drilling fluid lubricated bearings fail completely.

When all of the above described structures are used for deep well drilling, the pressurized oil bath provides an ideal environment for the rotary driven tool carrying shaft supported with a relatively stationary housing supported from the bottom of the drill string. The various bearing assemblies can be utilized for different drilling conditions when more or less thrust and radial stresses must be controlled.

Each of these designs utilizes a pressurized oil bath for sustaining the operation of the bearings, in each case the oil bath can be additionally pressurized by a spring to preclude any leakage of extraneous fluid into the bearing chamber. Further, the bearing chamber and particularly the seals at the ends of the oil containing chamber, are completely insulated from explosure to any cuttings or other debris such as diamond particles chipping off the cutting tools or hard metal particles that might be carried upwardly in the flushing fluid that washes the cutting zone where the tool is active and, of course, wears during the rugged drilling operations to which such tools are subjected.

Lastly, it should be observed that if, despite all precautions, should any of the oil chamber seals fail so that all the oil is forced out of the main radial and thrust bearing chamber, only drilling fluid can enter this chamber and none of the debris containing flushing fluid moving upwardly in the well around the housing means for the bearings, can enter the main bearing chamber. Under these conditions, although admittedly not ideal, the refined drilling fluid slurry forced down the drill string under great pressure to drive the downhole motor and wash the cuttings out of the well, is directed around and through the bearing means to provide some lubrication without causing undue wear. The design shown in FIG. 6 is especially useful in difficult drilling operations where the possibility of seal failure can be anticipated due to longer operating periods and faster operating speeds. When the seals fail in the construction, the arrangement permits a flow of drilling fluid to proceed from space 424 with casing 406, past bearing 414–416 which permits a restricted flow therethrough when there is no pressure on the underside thereof after all the pressure on the oil in the bearing chamber has been dissipated and then the drillng fluid can flow down the stack of angular contact or other bearings in bearing chamber 444 and through the journal bearing 456 in the lower bearing housing. Such bearings could be operated for many hours after oil pressure has been lost from the normally pressurized bearing chamber.

The above description covers the preferred forms of the invention. It is possible that additional modifications may occur to those skilled in the art that will fall within the scope of the following claims.

We claim:

1. A bearing means for the driven shaft of a rotating tool in an oil well or the like, the driven shaft being hollow to convey drilling fluid flowing down the drill string to a drill bit, there being a motor adapted to rotate the driven shaft and wherein the drilling fluid is forced down the drill string under pressure to flow through and then out of the drill bit to clear debris from around the tool and flush the debris out of the well, comprising relatively stationary tubular means supported from the lower end of the drill string having an interior wall forming a chamber, said driven shaft extending downwardly through said chamber and having its outer wall spaced from the interior wall of said tubular means, said shaft supporting said drill bit on its lower end and being rotatably supported within said chamber with the drill bit extending beyond the lower end of said tubular means, main bearing means within said chamber for rotatably supporting said driven shaft, rotary face seal means enclosing a space within said chamber, said seal means being disposed above and below said main bearing means, said main bearing means including radial bearing means disposed immediately adjacent said rotary face seal means within said chamber, oil confined within said chamber between said rotary seals for lubricating said bearing means, means to pressurize the oil confined within said chamber, and means for directing the drilling fluid flowing in said hollow shaft in a manner to produce a balanced drilling fluid pressure above and below said rotary face seal means, and a restricted outlet passage to exhaust the directed drilling fluid from between said hollow driven shaft and said tubular means and into the well.

2. A bearing means as in claim 1 wherein said radial bearing means is an angular contact bearing means.

3. A bearing means as in claim 1 wherein said radial bearing means is an elongated roller bearing means.

4. A bearing means as in claim 1 wherein said means to pressurize the oil includes a piston compensating means, means behind said piston to urge said piston in a direction to pressurize said oil, and means to admit drilling fluid from said hollow shaft behind said piston.

5. A bearing means as in claim 4 wherein said piston is slidably mounted on said driven shaft.

6. A bearing means as in claim 4 wherein said piston is mounted in a sleeve that rotates with said driven shaft.

7. A bearing means as in claim 6 wherein said piston is slidably mounted on said driven shaft.

8. A bearing means as in claim 7 wherein said sleeve has an outer wall that is spaced inwardly from the interior wall of said tubular means that forms said chamber.

9. A bearing means as in claim 4 wherein said means to pressurize said oil is positioned in said chamber between said radial bearing means that are adjacent the rotary seals.

10. A bearing means as in claim 1 wherein thrust bearing means are disposed within said chamber.

11. A bearing means as in claim 10 wherein said thrust bearing means are disposed adjacent to said radial bearing means.

12. A bearing means as in claim 4 wherein said piston is slidably mounted on the interior wall of said chamber.

13. A bearing means as in claim 4 wherein said piston is slidably mounted in a sleeve that is fixed to said stationary tubular means.

14. A bearing means as in claim 13 wherein said piston is slidably mounted on the interior wall of said chamber.

15. A bearing means as in claim 14 wherein said sleeve has an inner wall that is spaced from said driven shaft.

16. A bearing means as in claim 7 wherein said sleeve is positioned in said chamber between said radial bearing means.

17. A bearing means as in claim 4 wherein said piston is slidably mounted on the interior wall of said tubular means.

18. A bearing means as in claim 16 wherein said piston is mounted in a sleeve that is mounted integral with said tubular means.

19. A bearing means as in claim 17 wherein said sleeve is spaced outwardly from said driven shaft.

20. A bearing means as in claim 4 wherein said piston compensating means is positioned in said chamber outside of said enclosed space.

21. A bearing means as in claim 20 wherein said compensating means is mounted integral with said casing.

22. A bearing means as in claim 20 wherein said piston compensating means is above the uppermost of rotary seal means.

23. A bearing means as in claim 20 wherein said piston compensating means is slidably mounted on the interior wall of said chamber and said sleeve is mounted integral with said tubular means.

24. A bearing means as in claim 23 wherein said piston means has an upper and lower side and is exposed to drilling fluid pressure on its upper side to the pressure of drilling fluid flowing down the drill string and is exposed to the oil in said chamber on its lower side.

25. A bearing means for the driven shaft of a downhole motor for rotating a drill bit in an oil well or the like, the driven shaft being hollow to convey drilling fluid flowing down the drill string to the tool from a fluid powered motor adapted to rotate the driven shaft and wherein the drilling fluid is forced down the drill string under pressure to flow through the motor, the shaft and then through the drill bit to clear debris from around the tool and flush the debris out of the well, comprising relatively stationary tubular means supported from the lower end of the drill string having an interior wall forming a first chamber, said driven shaft extending downwardly through said first chamber and having its outer wall spaced from the interior wall of said tubular means and being rotatably supported within said chamber with the tool extending beyond the lower end of said tubular means, main bearing means in said first chamber fitted between said interior wall of said tubular means and the outer wall of said driven shaft for rotatably supporting said driven shaft, a pair of rotary face seal means one above and one below said first chamber, each of said seals having an inner face exposed toward said chamber and an outer face, a sleeve having top and bottom ends concentrically positioned within said tubular means forming a second chamber within said tubular means, said sleeve being spaced from said interior wall of said tubular means and the outer wall of said driven shaft, said sleeve being sealed at one end to the interior wall of said tubular means and open at its other end to said first chamber, a compensating piston slidably mounted between the outer surface of said sleeve and the interior surface of said tubular means for dividing the second chamber into two parts, a spring means in one of said parts to urge the piston toward the end of said sleeve that is open to said first chamber, oil for lubricating said main bearings filled under pressure into the other of said parts and into said first chamber, both of said rotary surface seals being exposed on their inner faces to the oil under pressure in said chamber and to the pressure of the drilling fluid on their outer surfaces, a passageway leading to the part of said sleeve containing the spring and adapted to conduct drilling fluid into said part of said sleeve to surround said spring means that urges the piston towards said chamber, and restricted outlet passage leading from outside said hollow driven shaft to permit slow leakage of the drilling fluid surrounding said spring means into the well.

26. A bearing means as in claim 25 wherein said sleeve is disposed above the uppermost of said rotary face seals.

27. A bearing means for the driven shaft of a downhole motor for rotating a drill bit in an oil well or the like, the driven shaft being hollow to convey drilling fluid flowing down the drill string to the drill bit from a fluid powered motor adapted to rotate the driven shaft and wherein the drilling fluid is forced down the drill string under pressure to flow through the motor, through the shaft, and then the drill bit and flush the debris out of the well, comprising relatively stationary tubular means supported from the lower end of the drill string having an interior wall forming a chamber, said driven shaft extending downwardly through said chamber and having its outer wall spaced from the interior wall of said tubular means and being rotatably supported within said chamber with the tool extending beyond the lower end of said tubular means, main bearing means fitted between said interior wall of said tubular means and the outer wall of said driven shaft within said chamber for rotatably supporting said driven shaft, rotary face seal means to form an enclosed portion within said chamber each having an inner face exposed toward said bearings in said chamber and an outer face facing away from said bearings, said seals being disposed above and below said main bearing means, a sleeve having a top and bottom ends concentrically positioned within said chamber and spaced from said interior wall of said tubular means and the outer wall of said driven shaft, said sleeve being sealed at one end to the outer wall of said driven shaft and open at its other end to the seal enclosed portion of said chamber, a compensating piston slidably mounted between the inner surface of said sleeve and the outer surface of said driven shaft, oil for lubricating said main bearings filled into said enclosed portion of said chamber and into said sleeve to urge said piston through said sleeve, both of said rotary surface seals being exposed on their inner faces to the oil in said enclosed portion of said chamber, both of said rotary surface seals being exposed on their outer faces to the drilling fluid pressure, a passageway to permit drilling fluid to flow from the center bore of the driven shaft into said sleeve to oppose the pressure of the oil that urges the piston through said sleeve, and a restricted outlet passage leading from between the hollow driven shaft and said tubular means to direct the drilling fluid which opposes the urge of the oil into the well.

28. A bearing means as in claim 27 including spring means for urging said piston toward said oil chamber.

* * * * *